US005458196A

United States Patent [19]

George et al.

[11] Patent Number: 5,458,196

[45] Date of Patent: Oct. 17, 1995

[54] THROUGH TUBING GUN HANGER

[75] Inventors: Flint R. George, Flower Mound; John D. Burleson, Denton, both of Tex.

[73] Assignee: Halliburton Company, Houston, Tex.

[21] Appl. No.: 299,224

[22] Filed: Aug. 31, 1994

[51] Int. Cl.[6] ..... E21B 43/119

[52] U.S. Cl. ..... 166/298; 166/120; 166/125; 166/137

[58] Field of Search ..... 166/117.7, 120, 166/125, 126, 134, 137, 298, 98, 206, 209, 212, 216

[56] References Cited

U.S. PATENT DOCUMENTS

| | | | |
|---|---|---|---|
| 2,190,442 | 2/1940 | Costello | 166/98 |
| 2,998,078 | 8/1961 | Carothers | 166/216 |
| 3,191,684 | 6/1965 | Pittman et al. | 166/216 |
| 3,266,571 | 8/1966 | St. John et al. | 166/298 |
| 3,280,913 | 10/1966 | Smith | 166/298 |
| 3,422,900 | 1/1969 | Hyde et al. | 166/137 |
| 4,605,074 | 8/1986 | Barfield | 166/55 X |
| 4,773,478 | 9/1988 | Streich | 166/125 X |
| 4,862,961 | 9/1989 | Neff | 166/127 |
| 5,025,861 | 6/1991 | Huber et al. | 166/297 |
| 5,156,213 | 10/1992 | George et al. | 166/297 |

*Primary Examiner*—Ramon S. Britts
*Assistant Examiner*—Frank S. Tsay
*Attorney, Agent, or Firm*—William M. Imwalle; Marcella D. Watkins

[57] ABSTRACT

A gun hanger for emplacement through a tubing string into a casing string, comprising an inner mandrel, a setting means slidably received on said mandrel, said setting means including a plurality of spaced apart, extendable slips mounted thereon such that operation of said setting means causes said slips to extend and engage the casing string, a slip release means slidably received on said mandrel such that operation of said slip release means causes said slips to retract and disengage from the casing string, said setting means and said release means having diameters less than the inside diameter of the tubing string when said slips are retracted, a centralizer mounted on and extending axially from the hanger, said centralizer comprising a stem and a plurality of evenly circumferentially spaced longitudinal bow springs flexibly mounted thereon, said bow springs being longitudinally spaced along said stem such that each spring longitudinally clears its preceding and succeeding springs when said springs are compressed.

20 Claims, 9 Drawing Sheets

THROUGH TUBING GUN HANGER

TECHNICAL FIELD OF THE INVENTION

The present invention relates to an improved apparatus and method for positioning perforating gun assemblies in wells. More particularly, the present invention is a hanger that allows one or more perforating gun assemblies to be positioned in a well after the tubing and associated equipment have been installed in the well.

BACKGROUND OF THE INVENTION

In the past, perforating systems for use in completing or reworking wells have been run into wells on a pipe string or wire line and positioned and supported on a hanger. Alternatively, the perforating assemblies may be run into the well using a monobore completion string. Still another method for positioning the perforating assemblies entails running them into the well on a tubing string, connecting them to a wireline and lowering them to the desired position in the well, where they are anchored to the well casing. The wireline is typically detached and removed from the perforating assembly before the perforating operation.

Of these methods, it has been found most preferable to seat one or more perforating guns on a hanger or anchor that has been lowered and set in the casing at the desired depth. After the perforating guns are in position, the lowering equipment can be removed from the vicinity of the perforation, or from the well entirely. Thus the amount of unnecessary equipment in the vicinity of the perforation is minimized.

Conventional hangers, however, must be run into the well before any tubing string is emplaced because the hangers are typically too large to pass through a tubing string. If a tubing string is already in place in a well, as in the case of a well being reworked, it is difficult to position a hanger in the casing below the end of the tubing string without first removing the tubing string. Removal of the tubing string is undesirable, particularly in cases where the tubing string comprises expensive pipe and/or connections and it is preferred to keep the handling of the string to a minimum. In such cases, a wireline can be used to lower individual perforating guns through the tubing to the desired depth. The disadvantage to using a wireline is that each gun is fired separately, pressure and flow from the formation begin as soon as the first gun is fired, and the perforating operation is greatly prolonged. Alternatively, a through-tubing bridge plug can be used to support several perforating guns, but such a plug is not removable. Hence, a removable hanger that can be lowered through a tubing string and set below the tubing string is desired.

The hanger should be able to support several perforating guns, so that a desired length of pipe can be perforated simultaneously under preferred low-pressure conditions.

The hanger should also be self-centering in the well, with the centering means also being passable through the tubing string. If the hanger does not include a centralizer, it can be cocked or off-center in the casing, with the result that the hanger will not set properly, or may not set at all. Even if the hanger does set, other equipment, such as perforating guns, will not seat properly thereon if the hanger is cocked or off-center.

After perforation, the perforating guns can either be retrieved or dropped to the bottom of the well, depending on several factors. Hence, a hanger is also desired that can be easily operated under either circumstance, i.e., adapted either to maintain its position in the casing or to release itself from the casing and drop to the bottom upon perforation. Other objects and advantages of the invention will appear from the following description.

SUMMARY OF THE INVENTION

The present perforating gun hanger can be lowered and removed through small-diameter tubing, yet is capable of setting and supporting perforating guns in larger diameter casing that extends below the tubing string. The present hanger has a tool diameter $D_T$ that is less than the smallest inside diameter of the tubing string when the tool is in its running and released position. The hanger also includes locking, radially extending slips that engage the wall of the larger diameter casing when the hanger is set. The present hanger further includes a centralizer that contacts the casing wall and aligns and centers the hanger within the casing to ensure uniform engagement of the slips. The centralizer can also be compressed to pass through the smallest inside diameter of the tubing string.

The hanger of the present invention is adapted to either maintain its position in the casing throughout the perforating operation, or to release itself from the casing and drop to the bottom of the well after perforation. Furthermore, it is contemplated that the hanger may be initially installed within the well with and the perforating guns subsequently disposed similarly through the tubing and mounted atop the suspended hanger. Alternatively, the hanger may be disposed into the well with the perforating guns already suspended therefrom and below the hanger. Both configurations are considered to be within the scope of this invention.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENT

Figure 1:
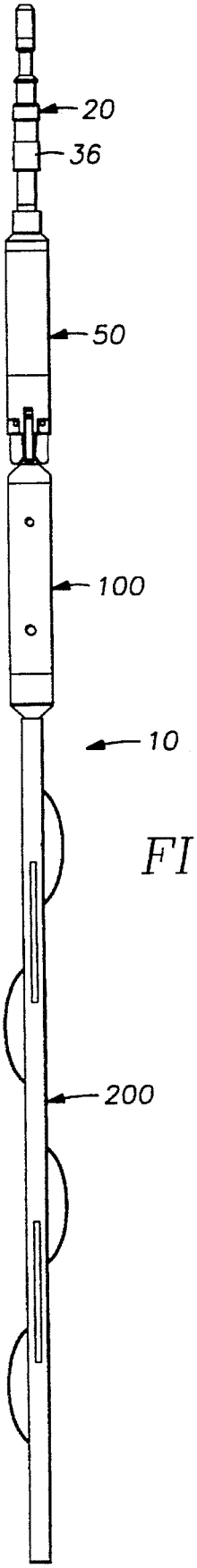
FIG. 1 is a side elevation of a preferred embodiment of the present hanger.
Figure 2A:
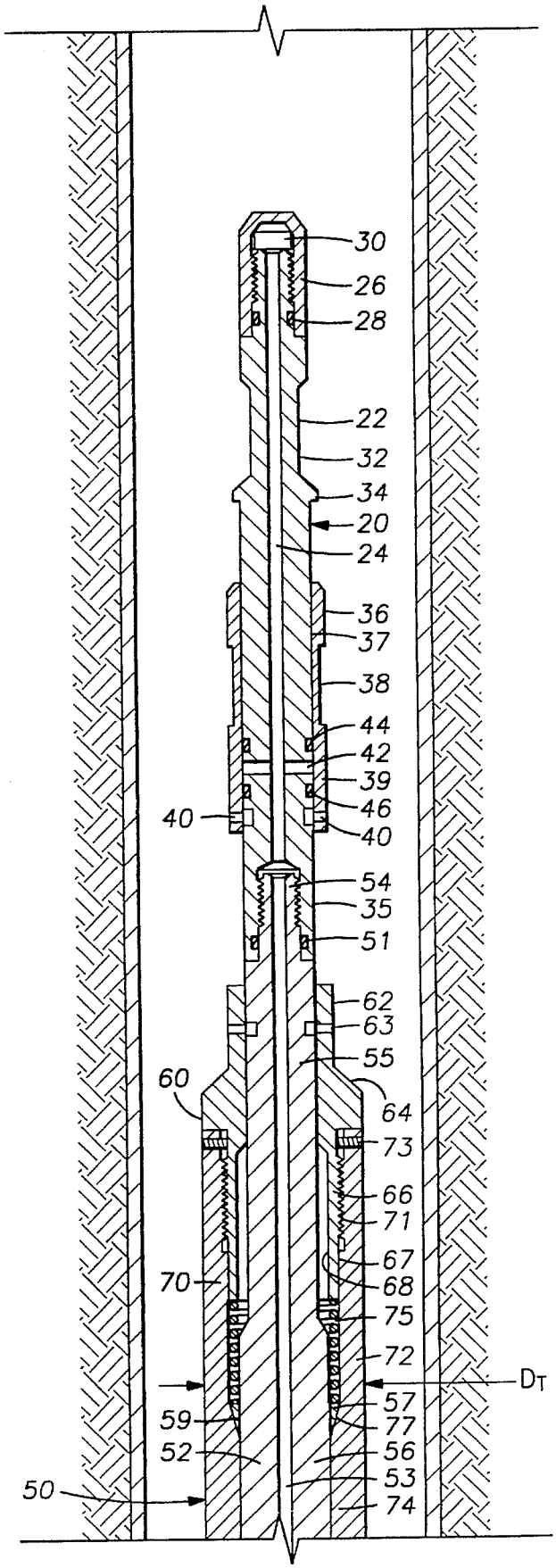
FIGS. 2A–C are a cross-section of the upper portion of the hanger of FIG. 1 in a position for running into the borehole of the well.

Referring initially to FIGS. 1 and 2A–C, perforating gun hanger 10 comprises a connection assembly 20, a setting assembly 50, a releasing assembly 100, and a centralizer assembly 200, which are longitudinally interconnected along a common axis. As shown in FIG. 2A, connection assembly 20 comprises a generally cylindrical body 22 having a central bore 24 therethrough. An end cap 26 is threaded onto the upper end of body 22. End cap 26 closes bore 24, forming a chamber 30 adjacent the upper end of body 20, which is sealed with an annular seal 28. Below end cap 26, body 22 includes a reduced diameter neck 32 and an enlarged diameter, downwardly facing annular shoulder 34. The lower end of body 22 includes a pin-receiving portion 35.

An annular shifting sleeve 36 is concentrically slidably mounted on body 22 between shoulder 34 and pin-receiving portion 35. Shifting sleeve 36 includes an upper latch portion 37, a reduced diameter portion 38, and a lower portion 39. Shifting sleeve 36 is held in position on body 22 by shear pins 40 passing through bores in lower portion 39 into aligned apertures in body 22. Body 22 includes at least one transverse radial bore 42 extending from central bore 24 to its outer diameter. In the running position shown in FIG. 1, radial bore 42 is closed by lower portion 39 of shifting sleeve 36, and is sealed by a pair of annular seals 44, 46.

Figure 2B:
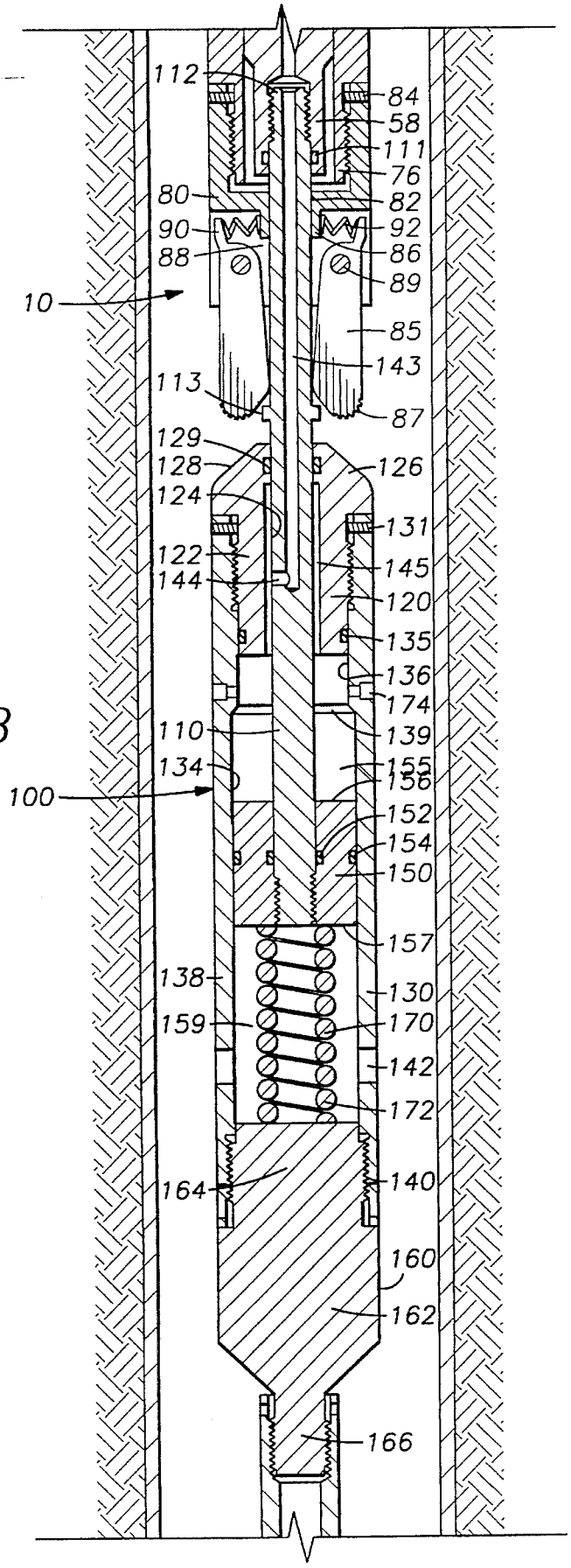

Referring to FIGS. 2A and 2B, setting assembly 50 of hanger 10 includes an inner mandrel 52, a top sub 60, an outer drive member 70, a slip body 80, and setting slips 85. Inner mandrel 52 is generally cylindrical and has a longitudinal central bore 53 therethrough. Inner mandrel 52 further includes a pin 54 at its upper end, a medial portion 55, an enlarged diameter portion 56, and a lower pin receiving portion 58 adjacent its lower end. At the upper end of mandrel 52, pin 54 is threadingly received in an enlarged bore in pin receiving portion 35 of body 22. An annular seal 51 is disposed between pin 54 and pin receiving portion 35. Central bore 53 of mandrel 52 communicates with bore 24 of connection assembly 20.

Top sub 60 includes an upper connection end 62, an annular shoulder 64, and a lock driving portion 66. Connection end 62 is affixed to the upper end of inner mandrel 52 by means of shear pins 63 extending through aligned bores in mandrel 52 and sub 60. Lock driving portion 66 is a downwardly extending annular skirt having an outer diameter 67 less than the outer diameter of shoulder 64. The inner diameter 68 of lock driving portion 66 is greater than the outer diameter of medial portion 55 of mandrel 52 and is sized to be slidably received on enlarged diameter portion 56.

Figure 4:
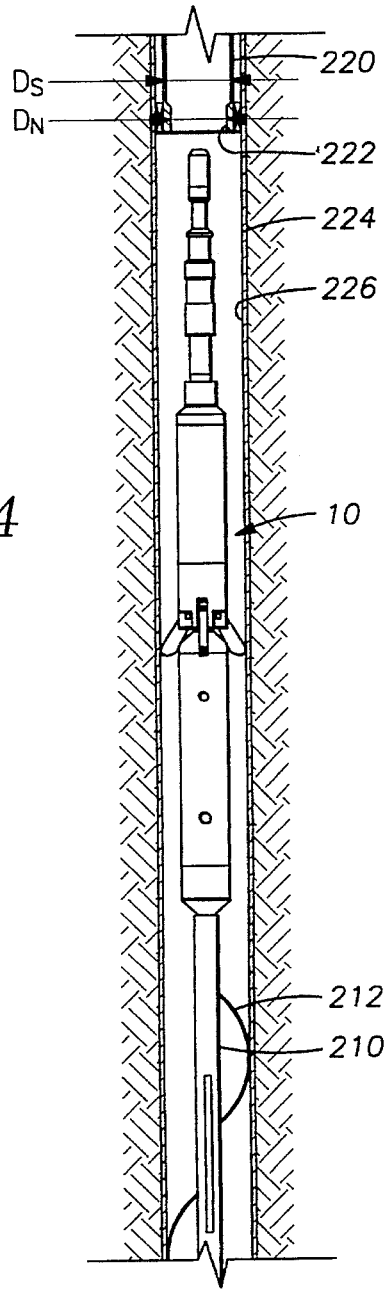
FIG. 4 is a cut-away elevation of the present hanger set in a casing string below a tubing string.

Outer drive member 70 is generally cylindrical and preferably has an outer diameter equal to the outer diameter of annular shoulder 64 of top sub 60. When hanger 10 is its running position, no portion of the hanger, except centralizer assembly 200, has a diameter greater than the outer dimension of shoulder 64 and drive member 70, which dimension will hereinafter be referred to as $D_T$. According to a preferred embodiment, hanger 10 may be provided in a range of sizes. For any given well such as shown in FIG. 4, a hanger 10 is selected having an $D_T$ less than the inside diameter $D_S$ of the tubing string 220 used in the well, so that it may be deployed and removed through the tubing string 220 if necessary.

Outer drive member 70 includes an upper, large bore portion 72, a medial small bore portion 74, and a slip body receiving portion 76. The inner diameter of large bore portion 72 receives outer diameter 67 of lock driving portion 66. The upper end of large bore portion 72 is preferably affixed to top sub 60 by means of threads 71 and set screws 73 or other similar fastening means. The inner diameter of small bore portion 74 is sized to slidably receive enlarged diameter portion 56. Slip body receiving portion 76 is generally tubular, and has an reduced outer diameter.

Figure 5:
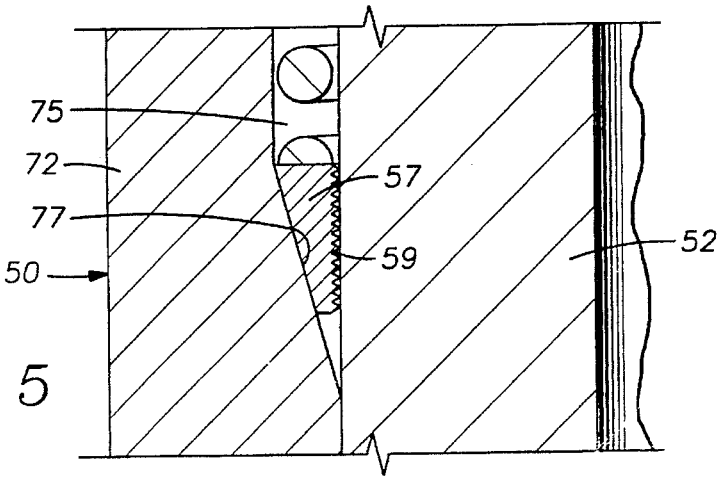
FIG. 5 is an enlarged cross-section of a portion of the hanger shown in FIG. 2A.

Referring now to FIGS. 2A and 5, an annular gap 75 is defined between lock driving portion 66, large bore portion 72 of outer drive member 70, and mandrel 52. Annular gap 75 includes a lower conical portion formed by a tapered transition 77 extending between large bore portion 72 and small bore portion 74. Within the conical portion of gap 75, a plurality of arcuate body lock segments 57 are disposed around enlarged diameter portion 56. Segments 57 have an outer tapered surface forming a circumferential locking wedge as best shown in FIG. 5. On this inner surface, body lock segments 57 include inner threaded or serrated surfaces 59 for frictional engagement with the inner cylindrical wall of mandrel 52. A coil spring 61 is disposed between lock driving portion 66 and body lock segments 57, which biases segments 57 toward outer drive member 70. The biasing of segments 57 causes the outer tapered surfaces of segments 57 to cam inwardly on tapered transition 77, forcing serrated surfaces 59 against outer drive member 70. In the running position shown in FIGS. 1 and 2A–C, lock driving portion 66 abuts spring 59 but does not extend over enlarged diameter portion 56.

Referring again to FIG. 2B, slip body 80 has an enlarged threaded counterbore at its upper end for threadingly receiving the lower end of outer drive member 70. A central bore 82 passes through the lower end of slip body 80 for receiving a portion of releasing assembly 100. Slip body 80 has an outer diameter equal to $D_T$, and the counterbore has an inner diameter that is sized to receive slip body receiving portion 76. Slip body 80 is preferably threaded onto slip body receiving portion 76 and is affixed thereto by means of set screws 84 or similar fastening means. Extending coaxially from the lower end of slip body 80 is a reduced diameter tubular support 86 and a plurality of slip mounting extensions 88 forming slots for slips 85.

According to a preferred embodiment, four setting slips 85 are evenly circumferentially spaced about the hanger 10 and pivotally mounted within the slots on pins 89 extending between adjacent slip mounting extensions 88. If the diameter of the pipe in which hanger 10 is to be set is large, six or more slips may be used instead of four. Slips 85 are generally planar oblongs, pivotally mounted at their upper ends on pipe 89 and having serrations or teeth 87 around their distal ends. A tang 90 projects from the upper end of each slip 85 and has an inwardly facing bearing surface. Slips 85 preferably lie in two perpendicular planes. Each slip is mounted in a manner that allows it to pivot around an axis that is perpendicular to both the hanger axis and its own plane.

A biasing means 92 is disposed between tubular support 86 and the bearing surface of tang 90 of each slip. As shown in FIG. 2B, biasing means 92 is preferably a coil spring. As shown in FIG. 2B, when the hanger is in its running position, biasing means 92 is extended and tang 90 is fully biased away from the axis of the hanger 10, causing the distal end of each slip 85 to be in a contracted position and at a minimum radius.

Still referring to FIG. 2B, releasing assembly 100 includes a mandrel extension 110, a cone section 120, a sleeve 130, a piston 150 and a closure 160. Extension 110 extends between slips 85 and through central bore 82 in slip body 80 and tubular support 86. The upper end 112 of extension 110 is threadingly received in pin receiving portion 58 of mandrel 52 and sealed with an annular seal 111. In the running position, the distal ends of slips 85 rest on extension 110. Extension 110 also includes a small annular shoulder 113 located just below slips 85.

Cone section 120 preferably comprises a tubular body 122 having an integral cam head 126 forming its upper end and a central bore 124 through which extension 110 extends. An annular seal 129 is disposed between extension 110 and the inner cylindrical surface forming bore 124. Cam head 126 has an annular upwardly facing camming shoulder 128 and a outer diameter equal to $D_T$. Cone section 120 is mounted on extension 110 below slips 85, with shoulder 128 and is held in position relative to extension 110 by the presence of pressurized fluid between it and piston 150, as discussed in greater detail below.

Still referring to FIG. 2B, cylindrical sleeve 130 has an outer diameter equal to $D_T$ and an inner enlarged bore 134, and is mounted on tubular body 122 of cone section 120. Sleeve 130 is preferably threaded onto cone section 120 and affixed by means of set screws 131 or similar fastening means. Near the upper end of inner bore 134 is a reduced diameter portion 136, which forms a downwardly facing piston stop 139. An annular seal 135 is disposed between reduced diameter portion 136 and the tubular portion 122 of cone section 120. Below piston stop 139, the center portion of sleeve 130 has a constant diameter and forms a cylinder 138. The lower end of sleeve 130 has a reduced thickness and forms a threaded closure receiving portion 140.

Closure 160 comprises a body 162, including an upper reduced diameter spring support 164 and a lower centralizer mount 166. Spring support 164 is threaded into closure receiving portion 140.

Piston 150 is threaded onto the lower end of extension 110 and is reciprocably disposed within cylinder 138. A pair of annular seals 152, 154 are disposed between piston 150 and extension 110 and between piston 150 and sleeve 130, respectively. Piston 150 has an upper face 156 and a lower face 157. Piston 150 forms an upper annular fluid chamber 155 within cylinder 138, defined by upper face 156, the wall of cylinder 138 and the lower end of cone section 120 and a lower chamber 159 within cylinder 138 formed by lower face 157, the wall of cylinder 138 and spring support 164. One or more open ports 142 are located just above closure receiving portion 140 and allow communication between the lower chamber 159 of cylinder 138 and the outside of the hanger 10.

Extension 110 extends from piston 150 in cylinder 138 through cone section 120. A fluid passage 143 extends from the upper terminal end of extension 110, where it is in fluid communication with central bore 53 of mandrel 52. Passage 143 terminates within extension 110 adjacent central bore 124 of cone section 120. A transverse radial passage 144 extends through the cylindrical wall of extension 20 and communicates the terminus of passage 143 with central bore 124. According to a preferred embodiment, a small annulus 145 is provided between cone section 120 and mandrel extension 110, either by counter-boring cone section 120 (as shown), or by reducing the diameter of extension 110 in the region between chamber 155 and passage 144. Annulus 145 permits fluid to flow easily from chamber 155 into passage 144.

Figure 2C:
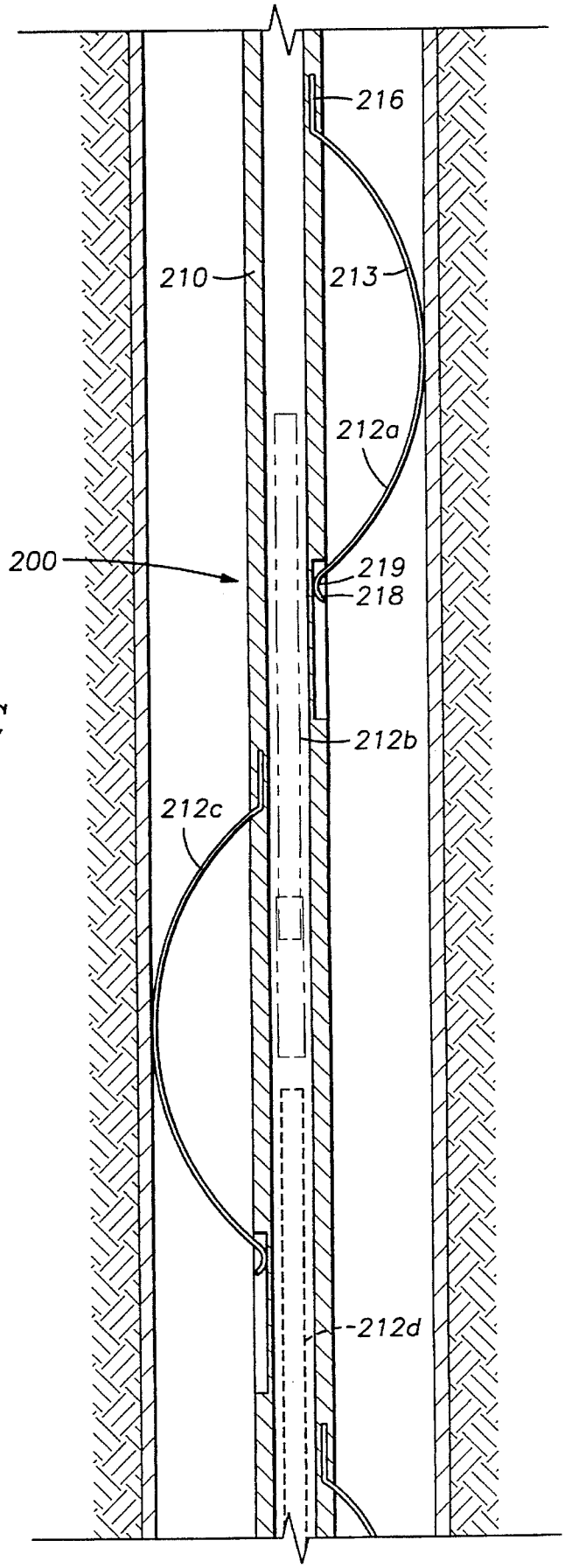

When hanger 10 is in the running position shown in FIGS. 2A–C, before it is operated, piston 150 is disposed approximately midway between piston stop 139 and spring support 164. A biasing means 170 is disposed within lower chamber 159 between lower piston face 157 and spring support 164. According to a preferred embodiment, biasing means 170 is a coil spring 172, as shown. In the running position, spring 172 is fully compressed, and therefore bears on piston 150, biasing it upwards within cylinder 138. In the running position, the spring force on piston 150 is balanced by the presence of a pressurized incompressible fluid sealed in upper chamber 155, which bears on face 156.

The incompressible fluid is placed upper in chamber 155 and pressurized during assembly of the hanger 10, through one or more fill ports 174 extending radially through reduced diameter portion 136 of sleeve 130. The pressurized fluid extends up through a central fluid passageway in hanger 10 formed by passages 144 and 143 and bores 53 and 24 to chamber 30 in end cap 26. As the fluid under pressure flows into chamber 155, piston 150 is forced away from cone section 120, compressing spring 172. After hanger 10 is fully pressurized and spring 172 is compressed, ports 174 are closed and sealed. According to a preferred embodiment, hanger 10 is assembled with a small gap between shoulder 128 of cone section 120 and shoulder 113 and with spring 172 slightly less than fully compressed. The gap allows for thermal expansion of the fluid in chamber 155 that occurs when the tool is run in the hole. Once the fluid in chamber 155 has expanded, shoulder 128 contacts shoulder 113 and spring 172 is preferably fully compressed, as shown in FIG. 3B.

Referring now to FIG. 2C, centralizer assembly 200 is mounted on centralizer mount 166 of releasing assembly 100. Assembly 200 comprises a long, generally tubular stem 210 having a plurality of resilient, arcuate bow springs 212*a*, 212*b*, 212*c*, 212*d* etc. longitudinally mounted thereon. Each spring 212 has one end 216 embedded in or otherwise affixed to stem 210, while its other, free end 218 rides freely in a longitudinal groove 214 in the outer wall of stem 210. According to a preferred embodiment, the free end 218 of each spring includes a loop or finger 219, which facilitates movement of end 218 in groove 214 by virtue of its curved surface. Between its ends, each spring 212 forms an arc 213 that extends radially away from stem 210 so that the largest diametrical dimension of centralizer assembly 200 is greater than $D_T$ and is preferably slightly greater than the inside diameter of the casing into which the hanger 10 is to be set. The largest diametrical dimension of centralizer 200 occurs when springs 212 are in their expanded and relaxed state. Each successive spring 212*a*, 212*b*, 212*c* etc. is preferably circumferentially offset 90° from any adjacent spring. In addition, each spring 212*b* is preferably longitudinally offset a sufficient distance from the preceding and following springs 212*a*, 212*c* that the compressed profile of spring 212*b* substantially longitudinally clears the compressed profile of springs 212*a* and 212*c* when the hanger is run through tubing string 220 and the springs 212 are compressed to the inside diameter $D_S$ of the tubing string 220. Because of the circumferential and longitudinal spacing between successive pairs of springs, springs 212 define a spiral around the axis of hanger 10 as shown in FIG. 1.

OPERATION

To perforate a well, the present hanger 10 is run into the well on a tubing string or wireline. During the run-in operation, the elements of the hanger 10 are interrelated as shown in FIGS. 2A–C. If a tubing string is already in place in the well, as shown in FIG. 4, the hanger 10 can be run into the well through the tubing. Likewise, if the perforating guns and hanger are to be removed from the well after perforation, it will be necessary to remove them through the tubing string. In these cases, where the hanger 10 is to be run in or out (or both) through the tubing string, $D_T$ must be less than the inside diameter of the tubing string $D_S$ and centralizer assembly 200 must be radially compressed in order to pass through the tubing.

Referring now to FIG. 4, the tubing string 220 is suspended from the surface within an outer casing string 224.

The casing string 224 extends through one or more hydrocarbon production zones (not shown). It is the object of the present hanger 10 to support one or more perforating guns on the end of hanger 10, so as to locate the guns adjacent one of the production zones. A profile nipple 222 typically is disposed on the lower end of the tubing string 220. Nipple 222 has a smaller inside diameter $D_N$ than tubing string 220. Hence $D_T$ must be smaller than $D_N$. It is in the passage of centralizer assembly 200 through nipple 222 that the novel configuration of bow springs 212 becomes important. Specifically, the present centralizer assembly 200 eliminates the conventional pairs of opposed springs and replaces them with longitudinally offset, spiral-mounted individual springs 212. Because of the longitudinal offset, as any given section of centralizer 200 passes through nipple 222, only one spring 212 at a time will have to be compressed, instead of an opposed pair of springs. This means that the smallest diameter through which the compressed centralizer 200 can pass is smaller than for conventional centralizers. The weight of the hanger 10 alone will be sufficient to compress the springs and allow the hanger 10 to pass through nipple 222.

When the present centralizer assembly 200 enters the large diameter casing string 224, springs 212 attempt to expand and return to their noncompressed state, and thus bear on the wall of casing string 224. Because springs 212 are equally spaced around stem 210, which does not flex significantly, the opposing forces exerted by springs 212 are balanced as if the springs were mounted in opposed pairs and stem 210 is centered in the well, along with the rest of hanger 10. This contributes to the ability of the hanger 10 to be run in through a small ID tubing string and then set in a larger ID casing.

Figure 3A:
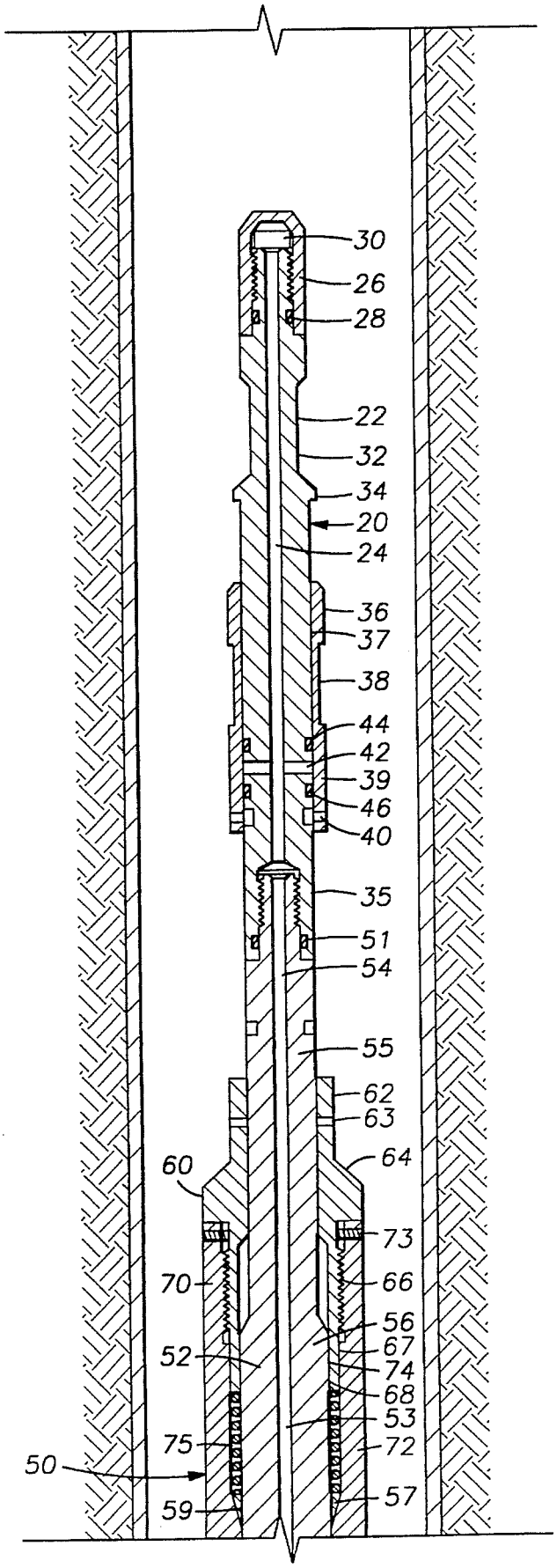
FIGS. 3A and 3B are a cross-section of the upper portion of the hanger of FIG. 1 set in a well.
Figure 3B:
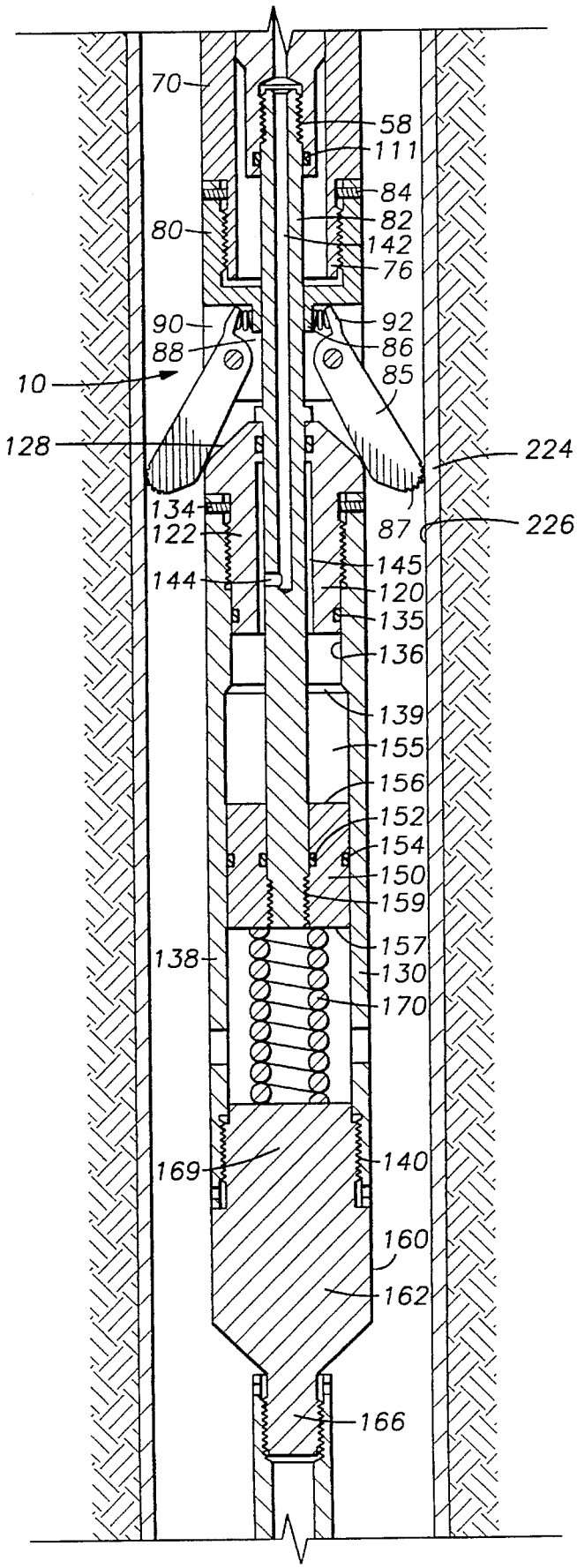

Referring now to FIGS. 3A and B, once hanger 10 has been lowered to the desired depth, hanger 10 is set in the casing string 224 using a conventional Setting tool (not shown). The setting tool is a tubular member which drops over connection assembly 20 with its lower end engaging shoulder 64 to apply a downward force on top sub 60, outer drive mandrel 70 and slip body 80 while retaining mandrel 52 stationary in position. This downward force shears shear pins 63 and advances top sub 60 and outer drive member 70 downward relative to mandrel 52. As top sub 60 advances down around mandrel 52, lock driving portion 66 is forced downwardly into the gap 75 between outer drive member 70 and mandrel 52. As it advances into the gap 75, lock driving portion 66 bears on spring 61 which in turn bears on the top of lock segments 57, camming serrated surfaces 59 downward and into the wall of mandrel 52. As outer drive member 70 moves down, it shifts slip body 80 down, causing slips 85 to cam outward on camming shoulder 128 until teeth 87 engage the wall 226 of casing string 224 as shown in FIG. 3B. Once teeth 87 engage the wall 226, the weight of hanger 10, plus that of any equipment placed on hanger 10, tends to force slips 85 outward. As slips 85 cam outward, springs 92 are compressed. Lock segment surfaces 59 are such that, once downward movement of segments 57 relative to mandrel 52 has occurred, it cannot be reversed. Thus, upward motion of top sub 60 and outer drive member 70 and the retraction of slips 85 is prevented.

After the hanger 10 has been set in this manner, other equipment, such as perforating guns, can be lowered into the well and supported on the hanger. Because hanger 10 is locked down and is self-supporting, several perforating guns can be positioned on the hanger 10 before being fired simultaneously. As many as 300 feet or more of casing string 224 can be perforated simultaneously without pulling the tubing string 220. This is advantageous because it eliminates the need to contend with well pressure during the perforating operation, as is the case when a wireline is used to lower and fire one gun at a time through the tubing string 220. Also, the tubing string or wireline used to lower perforating guns into the well can be removed from the vicinity of the production zone before perforating begins. Thus, the chance of damage upon detonation of the perforating charge is minimized.

Figure 6A:
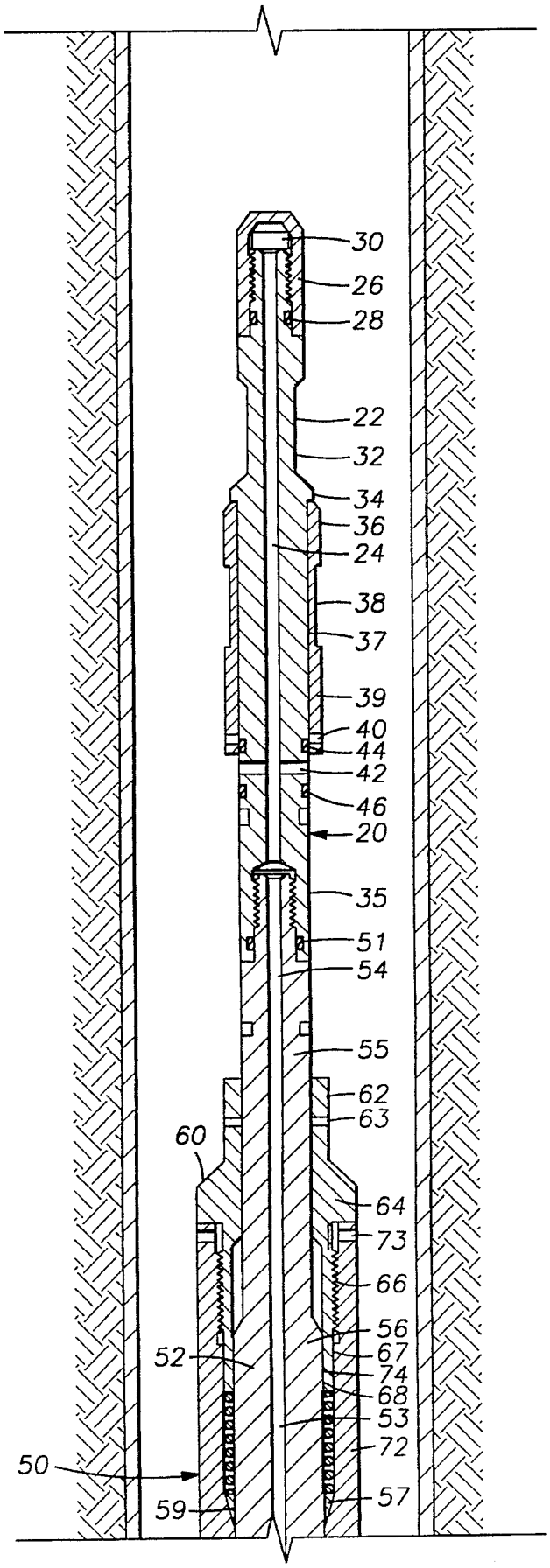
FIGS. 6A and 6B are a cross-section of the upper portion of the hanger of FIG. 1 in a released position.
Figure 6B:
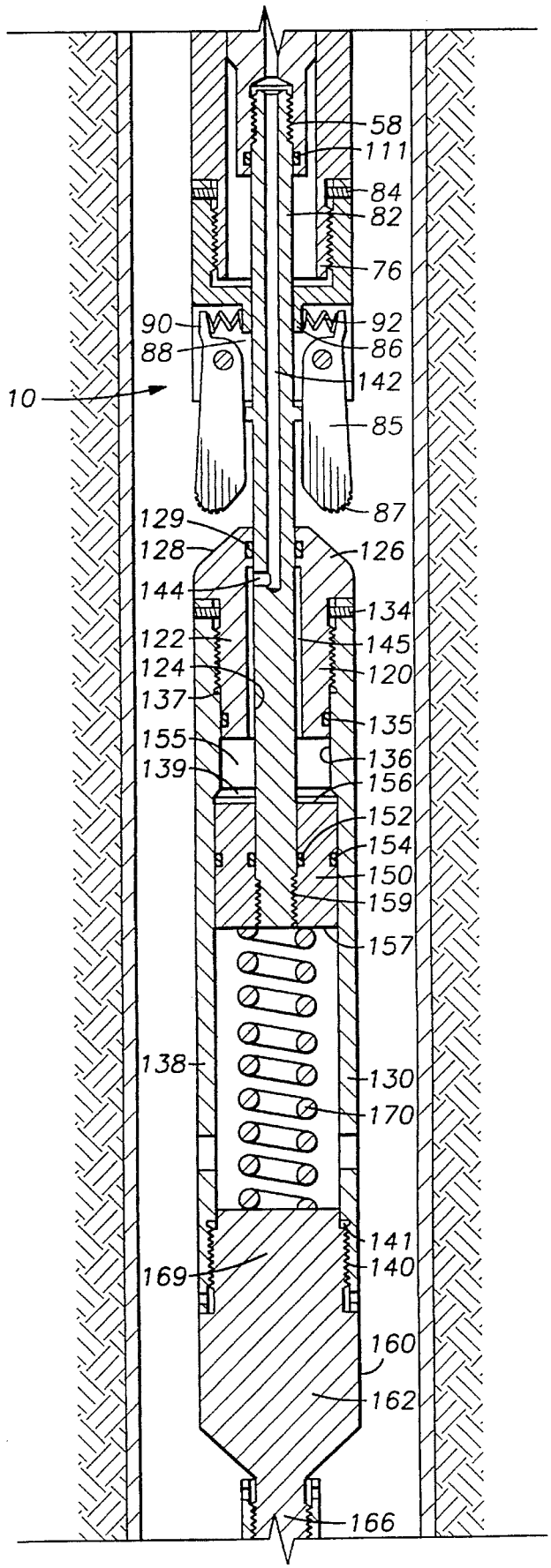
Figure 7:
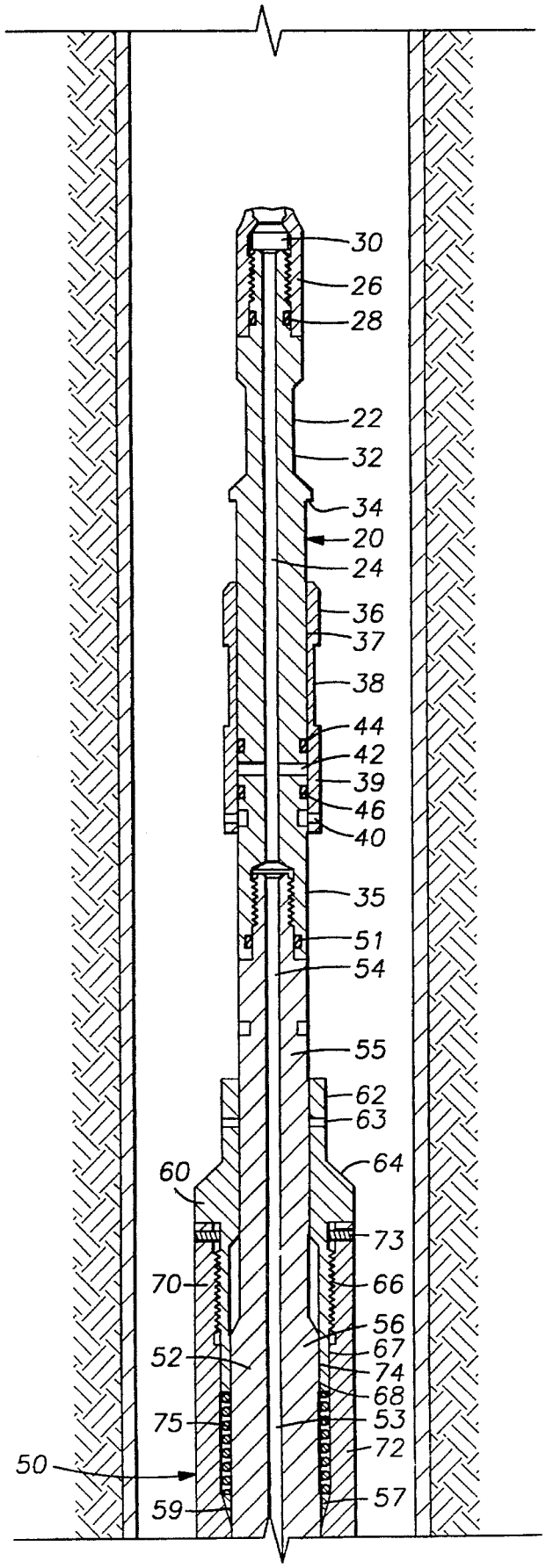
FIG. 7 is a cross-section of the upper portion of the hanger of FIG. 1 showing an alternate release mode.

Referring now to FIGS. 6A and 6B, if hanger 10 and the perforating guns are to be dropped into the well and abandoned after perforating, a downward-blasting charge may be included in the lowermost perforating gun. Upon detonation of this charge, end cap 26 is ruptured as shown in FIG. 7, thereby providing an egress for the pressurized fluid in chamber 155. The pressure reduction in upper chamber 155 removes the biasing pressure on piston 150 and allows spring 172 to expand, increasing the distance between lower piston face 157 and spring support 164. This pulls sleeve 130 and cam head 120 down along extension 110 and away from slips 85. As cam head 120 ceases to bear on slips 85, biasing means 92 expand and bear on tangs 90, causing slips 85 to pivot back to their contracted position, as shown in FIG. 6B. Once slips 85 have disengaged from casing wall 226 in this manner, hanger 10 is no longer supported and drops into the well. Bow springs 212 of centralizer 200 will still contact casing wall 226 at this point, but the friction resulting from this contact is insufficient to support the weight of hanger 10 and therefore does not prevent it from dropping into the well.

Referring now to FIG. 6A, if it is desired to retrieve the hanger following perforation instead of dropping it into the well, slips 85 can be released in a controlled fashion. After the perforating operation, the perforating guns are retrieved. A shifting tool (not shown) is lowered onto hanger 10 and engages upper latch portion 37 of shifting sleeve 36. Slips 85 are sufficiently engaged with wall 226 such that hanger 10 does not shift with sleeve 36. Shifting sleeve 36 is drawn up toward shoulder 34, shearing shear pins 40 in the process. This causes the lower portion 39 of sleeve 36 to clear radial port 42, allowing the pressurized fluid in chamber 155 to escape via passages 144, 143, 53 and 24 and port 42. As the fluid escapes, spring 172 expands as described above, with the result that slips 85 disengage from the casing wall.

Because hanger 10 is supported by engagement of the string or wireline with neck 32 and sleeve 36, it does not drop into the well when slips 85 retract and it can be pulled up out of the well for re-use. Hanger 10 can be removed even though a tubing string 220 is in place above it, as long as its largest diameter when slips 85 are retracted, $D_T$, is smaller than the smallest inside diameter $D_N$ of the tubing string. As during run-in, bow springs 212 compress radially toward stem 210 when hanger 10 enters the tubing string.

Although hanger 10 has been described in the context of perforating guns and a perforating operation, it will be understood that it can be used to support any type of equipment downhole, such as pressure recorders and/or fluid samplers. Likewise, one skilled in the art will recognize that various modifications to the hanger could be made without departing from the spirit of the invention. For example, various elements that have been disclosed as distinct elements for ease of manufacture may be combined as long as no relative motion is required therebetween. The elements of the tool could be reconfigured so that slips 83 rotated around their lower, rather than upper ends. Similarly, various fastening and biasing means can be substituted for those disclosed, and the number, shape and operation of slips 85 could be modified without substantively altering the invention. While a preferred embodiment of the invention has been shown and described, other modifications thereof can be made by one skilled in the art without departing from the spirit of the invention.

What is claimed is:

1. A hanger for supporting equipment in a well, comprising:

a mandrel member having upper and lower ends;

an outer member slidably received on said mandrel member;

a radially extensible wall-engaging means mounted on said outer member;

a retractable camming member slidably received on said mandrel member;

wherein said wall-engaging means is radially extended by advancement of said outer member toward said camming member along said mandrel member to a set position and is withdrawn by retraction of said camming member away from said outer member along said mandrel to a released position.

2. The hanger according to claim 1 wherein the well includes a tubing string and wherein said hanger is adapted to pass through the tubing string when said wall-engaging means are not extended.

3. The hanger according to claim 1 wherein said wall-engaging means is radially pivotally mounted on said outer member.

4. The hanger according to claim 1, further including a shear pin disposed between said mandrel and said outer member, said shear pin preventing movement of said outer member along said mandrel until sufficient force is applied to shear said pin.

5. The hanger according to claim 1, further including means for locking said outer member in its set position.

6. The hanger according to claim 1, further including a centralizer assembly, said centralizer assembly comprising a stem and at least three longitudinal bow springs spaced apart and flexibly mounted on said stem.

7. The hanger according to claim 6 wherein the well includes a tubing string and wherein said bow springs are vertically offset from each other along the stem such that each successive spring clears the preceding spring when said springs are compressed to a predetermined diameter.

8. The hanger according to claim 1, further including means for biasing said camming member to retract away from said outer member.

9. The hanger according to claim 8, further including a sealed chamber filled with pressurized fluid that prevents retraction of said camming member, such that release of said fluid allows said biasing means to retract said camming member.

10. The hanger according to claim 9 wherein said fluid is released through said mandrel member.

11. The hanger according to claim 10 wherein said mandrel member is adapted to release said fluid through either its upper end or through a radial port.

12. The hanger according to claim 11 wherein said mandrel member includes a piston affixed to its lower end and said chamber is formed between said piston, said mandrel member and said outer member, and said biasing means comprises a spring compressed between said piston and said outer member.

13. A hanger for supporting equipment in a well having a casing string and a tubing string, comprising:

a mandrel member having upper and lower ends;

an outer member slidably received on said mandrel member;

a radially extensible casing-engaging means mounted on said outer member. said casing-engaging means being radially pivotable with respect to said outer member;

a retractable camming member slidably received on said mandrel member, said camming member including a sealed chamber filled with pressurized fluid that prevents retraction of said camming member;

means for biasing said camming member away from said outer member, such that release of said fluid allows said biasing means to retract said camming member; and said casing-engaging means being radially extended by advancement of said outer member toward said camming member along said mandrel member and being withdrawn by retraction of said camming member away from said outer member along said mandrel; and a centralizer assembly, said centralizer assembly comprising a stem and at least three longitudinal bow springs spaced apart and flexibly mounted on said stem.

14. A method for supporting equipment in a well casing below a tubing string, the tubing string having a smaller inside diameter than the inside diameter of the casing, comprising:

running hanger through the tubing string, said hanger including radially extensible casing-engaging means; and setting said hanger below the tubing string by extending said casing-engaging means and engaging the casing therewith, the set hanger being capable of receiving and supporting equipment.

15. A method for perforating a well casing below a tubing string, the tubing string having a smaller inside diameter than the inside diameter of the casing, said method comprising:

running a hanger through the tubing string, said hanger including radially extensible casing-engaging means;

setting said hanger by extending said casing-engaging means and engaging the casing therewith;

lowering a perforating gun onto the hanger; and actuating said perforating gun.

16. The method according to claim 15 wherein a plurality of perforating guns are used.

17. The method according to claim 16, further including the steps of retrieving said perforating guns and then retrieving said hanger by releasing said wall-engaging means and withdrawing said hanger from the well through the pipe string.

18. The method according to claim 16, wherein said perforating gun includes a downward-blasting charge that causes said hanger to disengage from the casing and drop into the well.

19. A gun hanger for emplacement through a pipe string having a smallest inside diameter $D_1$ into a casing string having an inside diameter $D_2$, comprising:

an inner mandrel;

a setting means slidably received on said mandrel, said setting means including a plurality of spaced apart, extendable slips mounted thereon such that operation of said setting means causes said slips to extend to $D_2$ and engage the casing string;

a slip release means slidably received on said mandrel such that operation of said slip release means causes said slips to retract and disengage from the casing string;

said setting means and said release means having diameters less than $D_1$ when said slips are retracted;

a centralizer mounted on and extending axially from the hanger, said centralizer comprising:

a stem, and a plurality of evenly circumferentially spaced longitudinal bow springs flexibly mounted on said stem, said bow springs being longitudinally spaced along said stem such that each spring longitudinally clears its preceding and succeeding springs when said springs are compressed by passage through $D_1$.

20. The gun hanger according to claim 19 wherein said bow springs define a spiral around said stem.

* * * * *